US008167528B2

(12) United States Patent
Keeven et al.

(10) Patent No.: US 8,167,528 B2
(45) Date of Patent: May 1, 2012

(54) BACK SAVER LIFT

(76) Inventors: Ronald A. Keeven, New Haven, MO (US); Michael A. Keeven, Beaufort, MO (US); Laurence A. Keeven, New Haven, MO (US)

( * ) Notice: Subject to any disclaimer, the term of this patent is extended or adjusted under 35 U.S.C. 154(b) by 119 days.

(21) Appl. No.: 12/570,649

(22) Filed: Sep. 30, 2009

(65) Prior Publication Data

US 2010/0080682 A1 Apr. 1, 2010

Related U.S. Application Data

(60) Provisional application No. 61/101,477, filed on Sep. 30, 2008.

(51) Int. Cl.
*B66F 9/16* (2006.01)

(52) U.S. Cl. ..... 414/642; 414/629; 414/632; 414/637; 414/664; 414/672; 414/814; 187/232; 187/234

(58) Field of Classification Search ..... 414/620, 414/629, 632, 635, 637, 642, 664, 672, 814; 187/232, 234

See application file for complete search history.

(56) References Cited

U.S. PATENT DOCUMENTS

| | | | | |
|---|---|---|---|---|
| 3,939,999 | A | 2/1976 | Nielson | |
| 4,095,714 | A * | 6/1978 | Schuster | 414/607 |
| 4,143,782 | A * | 3/1979 | Dengler | 414/672 |
| 4,273,500 | A | 6/1981 | Yates | |
| 4,363,409 | A * | 12/1982 | Laurich-Trost | 212/300 |
| 4,394,107 | A | 7/1983 | Siebert | |
| 4,540,330 | A * | 9/1985 | Taylor | 414/641 |
| 4,921,389 | A * | 5/1990 | O'Daniel | 414/420 |
| 5,375,963 | A | 12/1994 | Wohlwend | |
| 5,417,541 | A | 5/1995 | Herron | |
| 5,975,826 | A | 11/1999 | Scholder | |
| 6,033,177 | A | 3/2000 | Kooima | |
| 6,099,234 | A | 8/2000 | Mason | |
| 6,343,674 | B1 * | 2/2002 | Sexsmith | 187/222 |
| 6,431,805 | B2 | 8/2002 | Lanciaux, Jr. | |
| 6,530,739 | B1 | 3/2003 | Friedman | |
| 6,543,566 | B1 | 4/2003 | Mason | |
| 6,551,050 | B1 * | 4/2003 | Kallevig et al. | 414/607 |
| 6,758,649 | B1 * | 7/2004 | Scordilis | 414/665 |
| 6,764,269 | B1 | 7/2004 | Cannata | |
| 7,014,007 | B2 | 3/2006 | Iwamoto | |
| 7,255,202 | B2 | 8/2007 | O'Keeffe | |
| 2004/0216299 | A1 | 11/2004 | Kobayashi et al. | |
| 2007/0134075 | A1 * | 6/2007 | Bunting | 414/23 |
| 2007/0205055 | A1 | 9/2007 | Renshaw | |
| 2008/0044265 | A1 | 2/2008 | Borntrager et al. | |

* cited by examiner

*Primary Examiner* — Scott Lowe
(74) *Attorney, Agent, or Firm* — Armstrong Teasdale LLP

(57) ABSTRACT

A lift that is configured to securely lift, carry and deposit a control unit using three degrees of movement. The lift comprises a chassis having a support frame and a power source connected to the support frame. A pivot member rotatably connects to the support frame, wherein the pivot member has a pivot plate and a rod rotatably connected to the pivot plate. A lift frame connects to the rod of the pivot plate, wherein a lift arm rotatably connects to the lift frame. The lift further comprises a pressurized fluid drive operatively connected to the power source and operatively connected to the pivot plate, the lift frame and the lift arm. The fluid drive is configured to reciprocally move the pivot plate, the lift frame and the lift arm such that the lift arm moves in three degrees of movement with respect to the chassis.

16 Claims, 8 Drawing Sheets

BACK SAVER LIFT

CROSS-REFERENCE TO RELATED APPLICATIONS

This application claims priority under 35 U.S.C. §119(e) to U.S. Provisional Patent Application No. 61/101,477 filed Sep. 30, 2008 and entitled "LIFT FOR ENVIRONMENTAL CONTROL UNIT AND METHOD OF LIFTING FOR SAME" and is incorporated herein by reference.

STATEMENT REGARDING FEDERALLY SPONSORED RESEARCH

Not Applicable.

BACKGROUND OF THE DISCLOSURE

The disclosure of the present application is a trailerable lift for moving environmental control units such as air conditioning and heating units. The lift is configured to securely lift, carry and deposit the control unit using three degrees of movement while at the same being compact and lightweight to allow the lift to be readily loaded onto and carried by a truck or trailer. Additionally, the lift is configured to minimize adverse weight effects of the unit applied to the ground or landscaping of the property as the lift and associated unit traverse the property grounds receiving the unit.

An environmental control unit comprises a large, heavy and bulky configuration. A typical enclosure of the unit has a "footprint" on the order of up to about two feet by about three feet, and may be six feet tall or more. Such a unit may weigh 400 to 1500 pounds. Once delivered to the location, the unit must be removed from a delivery truck or trailer and then placed in the proper location adjacent a home, an office or other building structure or within the home, office or building structure. This process can be difficult, in particular because of the size, weight, and location of the unit's center of gravity. The moving process of the unit can be more difficult in some terrains such as elevated or uneven, landscaped terrains.

During installation of the unit, workers or laborers hand-carry the units from the delivery truck to the installation location. The installation location may be supported a few feet off the ground by elevated brackets extending from a side of the building structure. Due to the physical parameters of the control unit, four to six workers hand-carry the unit from the delivery truck to the installation location. This moving process leads to difficult working conditions and leads to uneconomical use of the workers as the traversed ground often comprises uneven, or slick or disturbed soil resulting in injured workers and damaged ground. At the elevated installation site, the workers then jostle the unwieldy control unit which can lead to more injuries and/or improper installation of the control unit.

Sometimes, workers may use a skid to assist in transporting the unit from the delivery truck to the installation location. The unit's weight on the skid, however, damages the ground between the delivery truck and the installation unit. For a newly constructed home or office, this ground is typically landscaped and the unit installer must compensate the property owner for damage applied to the landscaped grounds. Additionally, these workers must manually lift the unit off of the skid and set the control unit on the installation site.

A forklift does not traverse well on uneven or moist grounds. Further, a forklift incorporates two degrees of movement which does not work for lifting and setting the control unit on the installation site when the forklift rests on uneven ground or when the forklift attempts to set the control unit on suspended brackets in a confined area of the building structure. Accordingly, workers and property owners require a lift that carries and deposits the control unit while eliminating or minimizing worker injuries and adverse weight effects of the unit applied to the ground or landscaping.

SUMMARY

A lift is disclosed that is configured to securely lift, carry and deposit a control unit using three degrees of movement. The lift comprises a chassis having a support frame and a power source connected to the support frame. A pivot member rotatably connects to the support frame. The pivot member has a pivot plate and a rod rotatably connected to the pivot plate. A lift frame connects to the rod of the pivot plate. The lift frame has opposing upright members that extend upward from the rod and has a lift arm rotatably connected to the upright members. The lift further comprises a pressurized fluid drive operatively connected to the power source and operatively connected to the pivot plate, the lift frame and the lift arm. The fluid drive is configured to reciprocally move the pivot plate, the lift frame and the lift arm such that the lift arm moves in three degrees of movement with respect to the chassis to properly deliver and set the control unit on an installation site.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure.

Referring to the figures, multi-functional lift device is disclosed. The device can be used for lifting, moving and setting any appropriate environmental control unit on a platform. However, for purposes of illustration only, the device will be described as incorporating a lift for setting an air conditioner unit on a building structure. The device can be of any size to accommodate users and/or units of any size.

Figure 1:
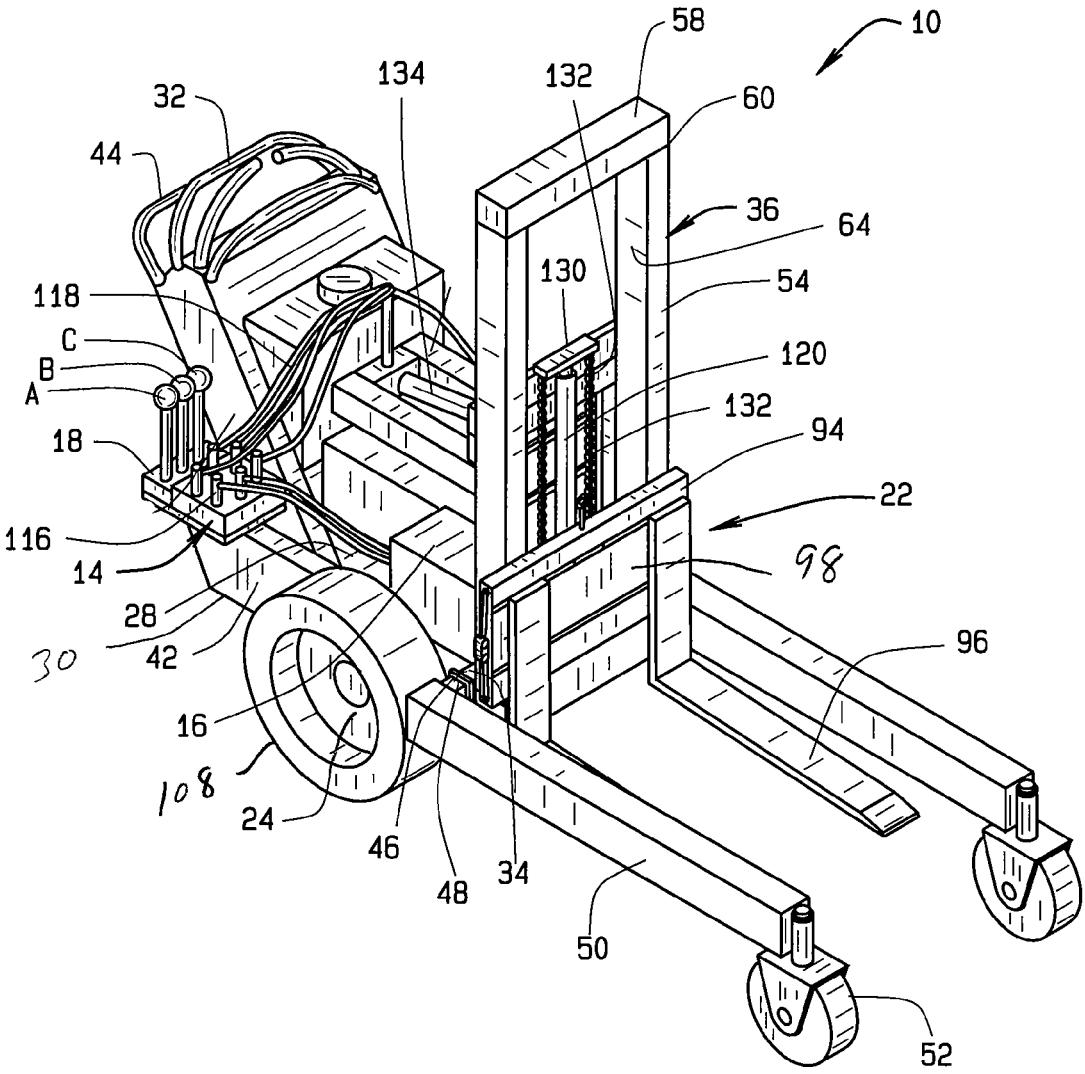
FIG. 1 is a perspective view illustrating the lift constructed in accordance with and embodying the present disclosure illustrating a chassis, a power source, a fluid drive, a lift frame and associated lift arm in the lowered position.

Referring to FIG. 1, a trailerable lift 10 is disclosed for moving air conditioning units 12 (FIG. 13) through three degrees of movement about a plurality of axis of the lift 10. The lift 10 includes a chassis 14, a power source 16, a fluid drive 18 and a control interface 20. The lift also includes a movable lift arm, generally shown as 22, attached to the chassis 14 and configured for selectively lifting, carrying and setting the air conditioning unit 12 of a given size on an installation site or platform. The control interface 20 (FIG. 12) allows a user to manipulate the power source 16 to move the chassis 14 via wheels 24 and to manipulate the fluid drive 18 to selectively position the movable lift arm 22 relative to the building structure 26.

Figure 4:
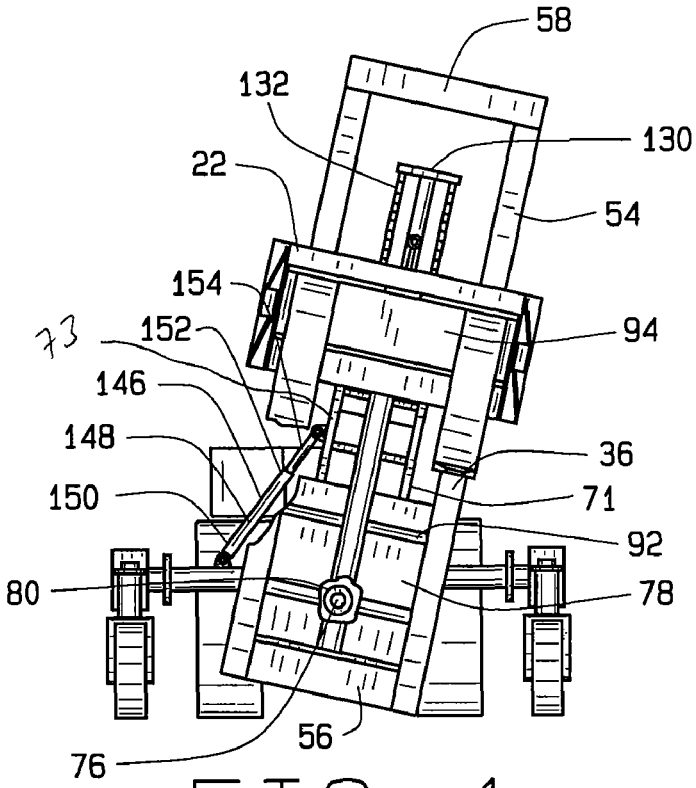
FIG. 4 is a front elevational view showing the lift frame and lift arm in a angled right position.
Figure 5:
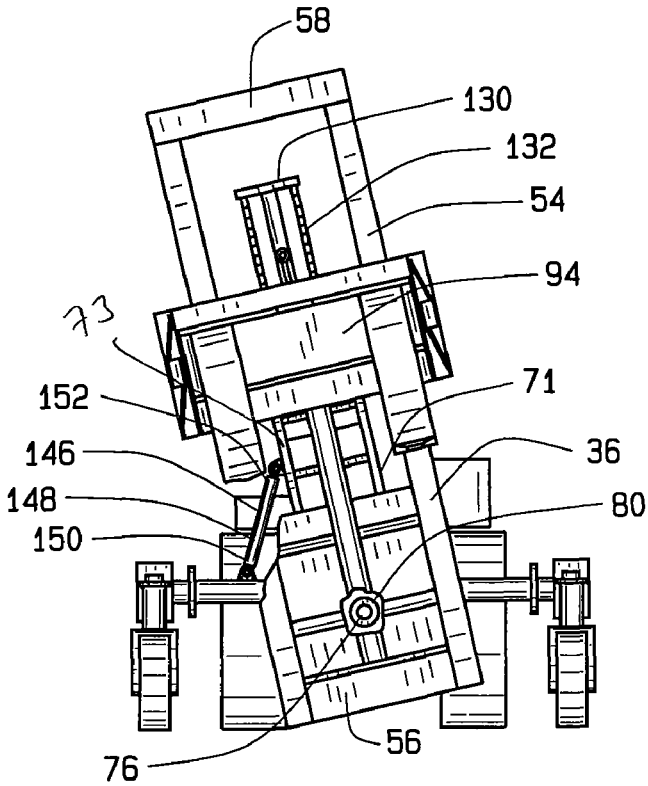
FIG. 5 is a front elevational view showing the lift frame and lift arm in a left angled position.

In particular, the fluid drive 18 operatively controls the lift arm 22 to allow the lift arm 22 to be raised and lowered (FIGS. 2 and 3); to be pivoted left and right (FIGS. 4 and 5) and to be tilted forward and backward (FIGS. 6 and 7) through the use of the control interface 20 (FIG. 20). Thus, the lift 10 of the present disclosure provides up to and including three degrees of movement for the lift arm 22 along different axis of the lift 10.

Figure 6:
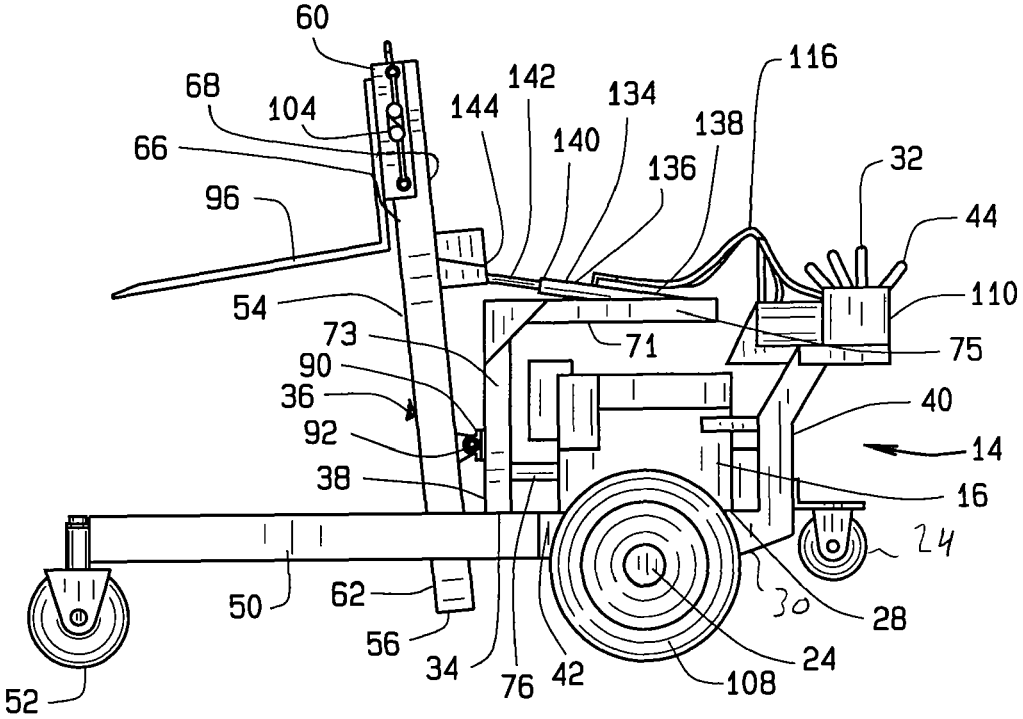
FIG. 6 is a side elevational view of the lift of the present disclosure illustrating the power source, the fluid drive, the lift frame and the lift arm in a forward tilt position.
Figure 7:
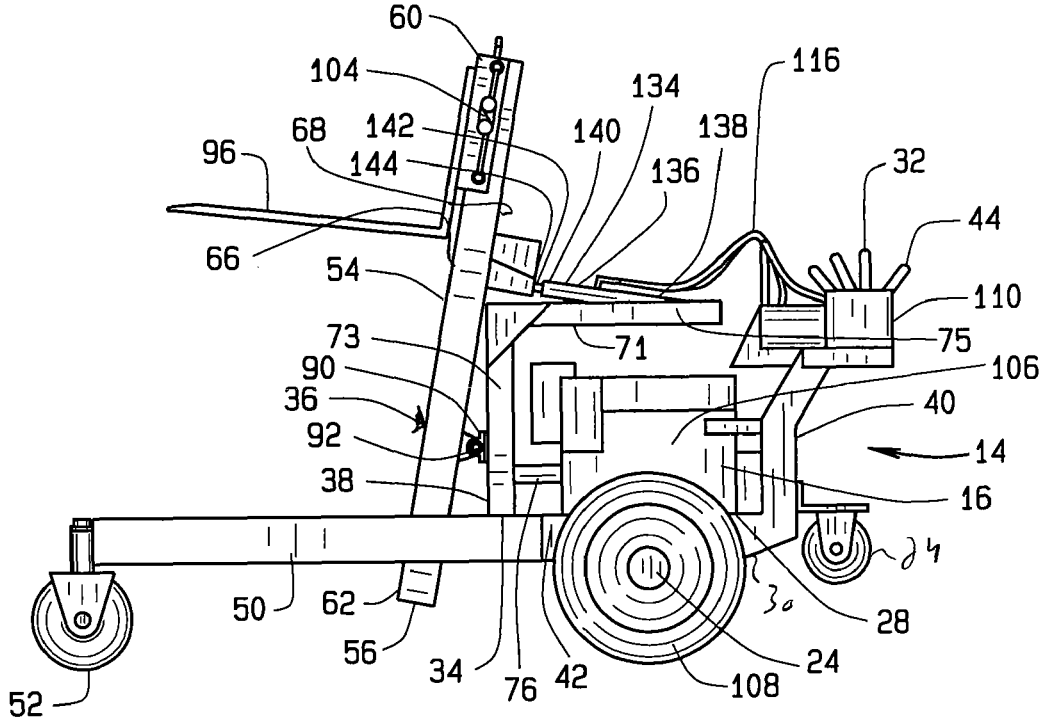
FIG. 7 is a side elevational view of the lift of FIG. 6 illustrating the power source, the fluid drive, the lift frame and the lift arm in a rear tilt position.
Figure 8:
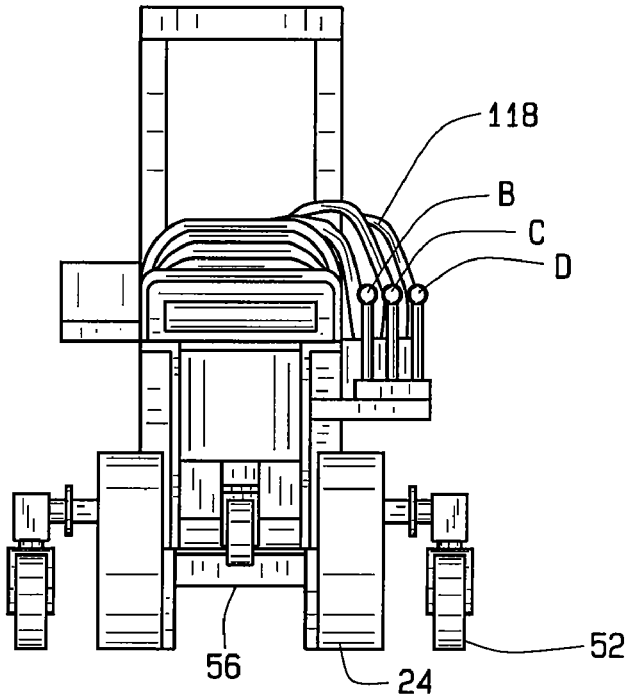
FIG. 8 is a rear elevational view of the lift of the present disclosure.

Turning to FIGS. 1, 6 and 7, the chassis 14 is sized and shaped to permit walk-behind operation of the lift 10. The chassis 14 includes an engine platform 28, a support frame 30, a handle 32, a wheel frame 34 and a lift frame 36. The engine platform 28 is sized and shaped to accept and support the power source 16 and the fluid drive 18. The support frame 30 includes a front end 38, a back end 40 and opposing sides 42 which are sized and shaped to support the lift frame 36 and the control interface 20. The handle 32 includes guardrails 44 to protect the user's hands during operation of the lift 10.

Figure 2:
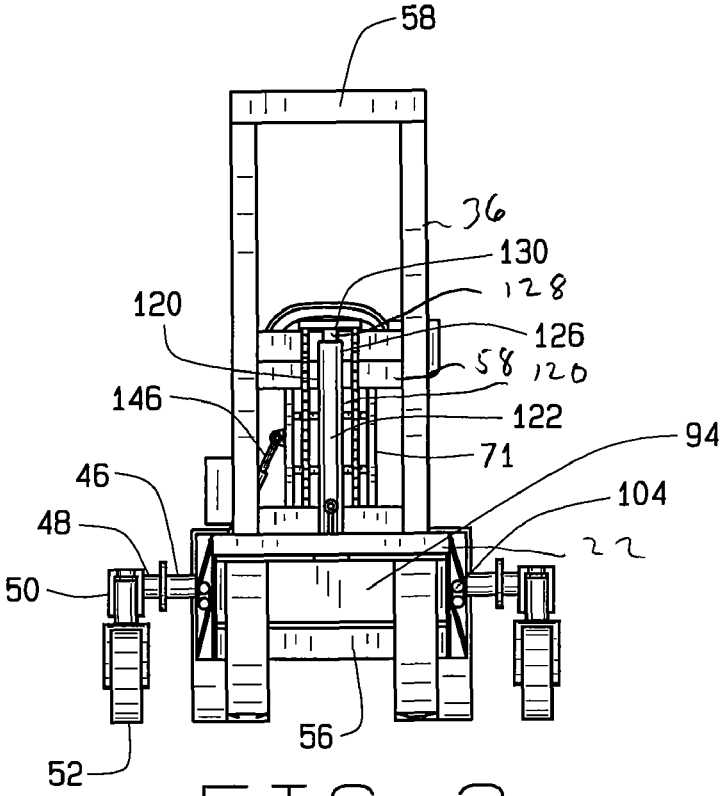
FIG. 2 is a front elevational view of the lift of FIG. 1 illustrating the lift arm in the lowered position.
Figure 3:
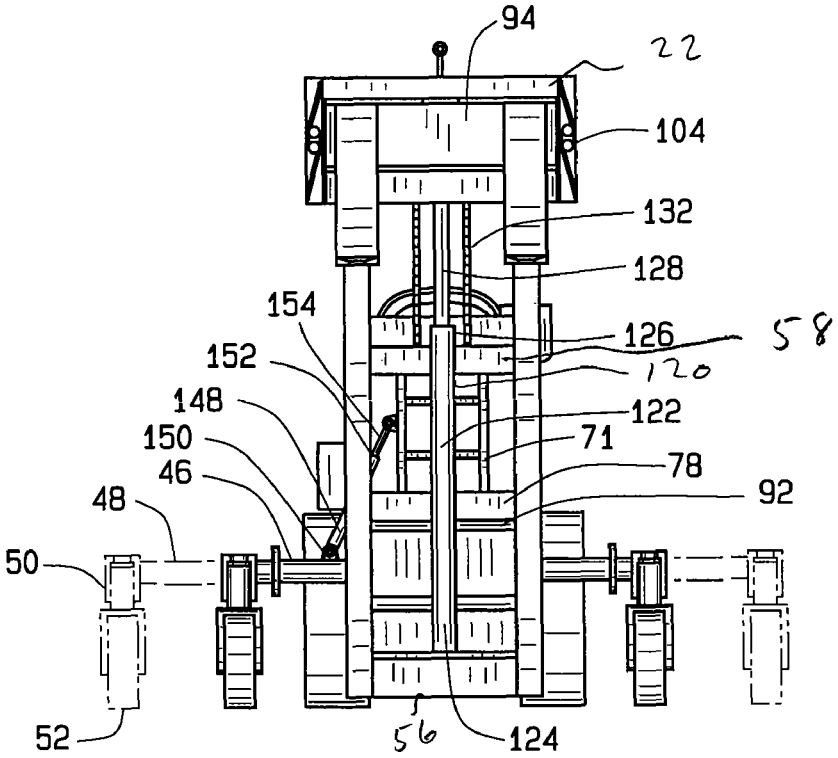
FIG. 3 is a front elevational view of the lift of FIG. 1 illustrating the lift arm in the raised position and illustrating wheels in adjustable positions.

Referring to FIGS. 1, 2 and 3, the wheel frame 34 includes a fixed member 46 connected to the front end of the support frame 30 and which extends across the front of the engine platform 28 to position open ends of the fixed member 46 beyond the opposing sides 42 of the support frame 30. The wheel frame 34 also includes reciprocating members 48 adjustably connected to the fixed member 46. The reciprocating members 48 are configured to fit within the open ends of the fixed member 46 to reciprocate inwardly and outwardly with respect to the open ends of the fixed member 46.

Figure 13:
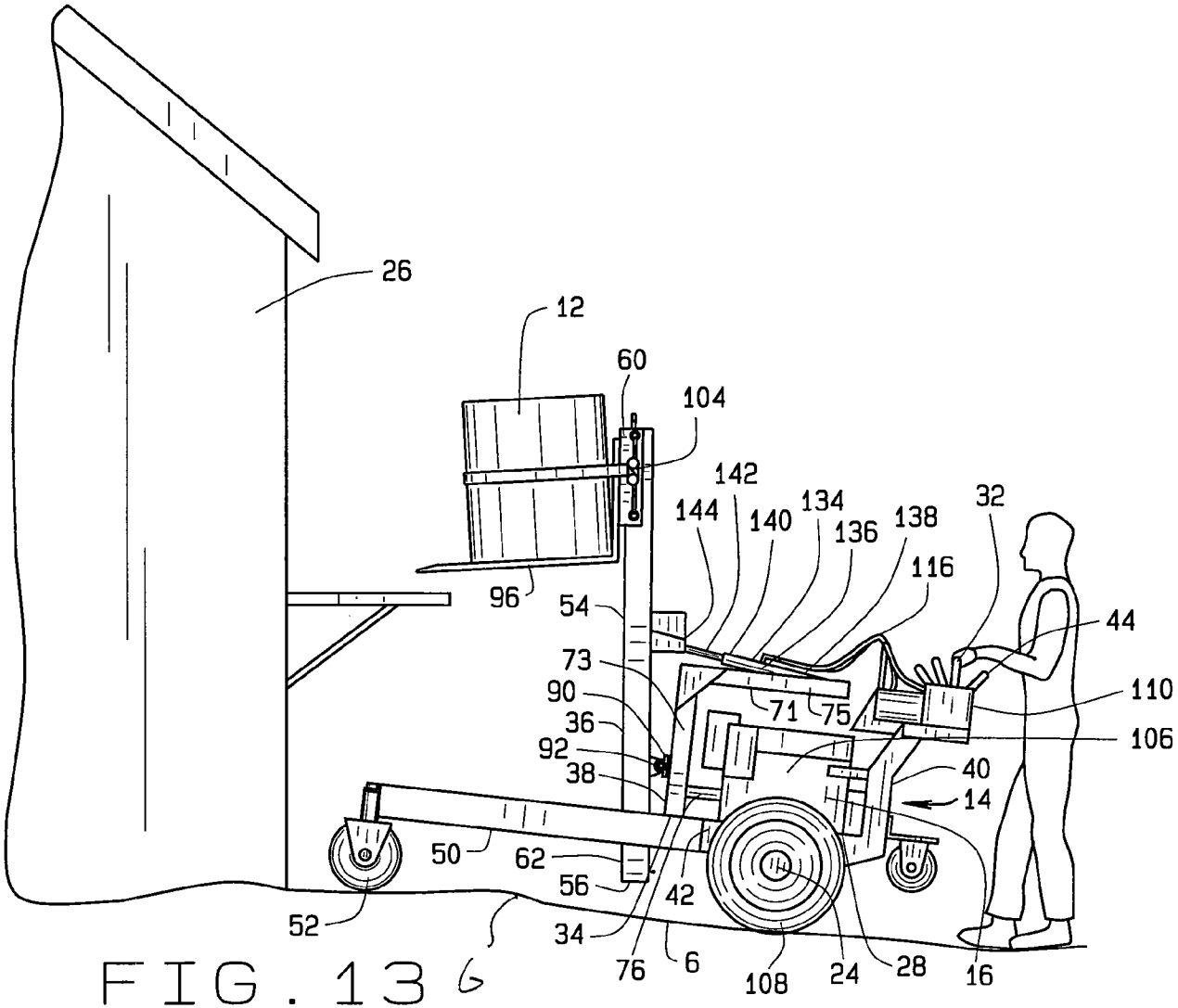
FIG. 13 is a side elevational view of a worker handling the lift which is suspending and depositing an environmental control unit on an elevated bracket suspended from a building structure.

Each reciprocating member 48 includes an outrigger 50 positioned opposite the open ends of the fixed member 46 such that the outriggers 50 extend perpendicularly outward from the fixed member 46. A wheel 52 operatively connects to the end of each outrigger 50. Since the reciprocating members 48 move inward and outward relative to the fixed member 46, the distance between the outrigger wheels 52 is adjustable. A fastener such as a cotter pin or clevis pin removably fastens the reciprocating members 48 to the fixed member 46 to maintain the outriggers 50 at a desired width setting. The outrigger wheels 52 are adjustably positioned to vary the center of gravity of the lift 10 and loaded unit 12 (FIG. 13). In one embodiment, the distance between the outriggers 50 is adjustable between thirty inches and sixty inches. This width distance, however, is representative of an embodiment and is not intended to limit the scope of the disclosure. The outriggers can be adjusted to smaller or larger distance ranges.

The lift frame 36 (FIGS. 1-8) includes spaced-apart upright members 54, a base member 56 and cross-supports 58. In an embodiment, the upright members 54 are spaced apart having upper ends 60, lower ends 62 and body members 64 positioned between the upper ends 60 and the lower ends 62. The base member 56 connects to the lower ends 62 of the upright members 54. The cross-support 58 connects the upright members 54. Turning to FIGS. 6-9, the upright members 54 have a front face 66 and back face 68 extending between the upper ends 60 and the lower ends 62. Between the front face 66 and back face 68, the body members 64 include oppositely spaced grooves 70 which form a track 72 that runs between the upper ends 60 and the lower ends 62 of the uprights 54.

Figure 11:
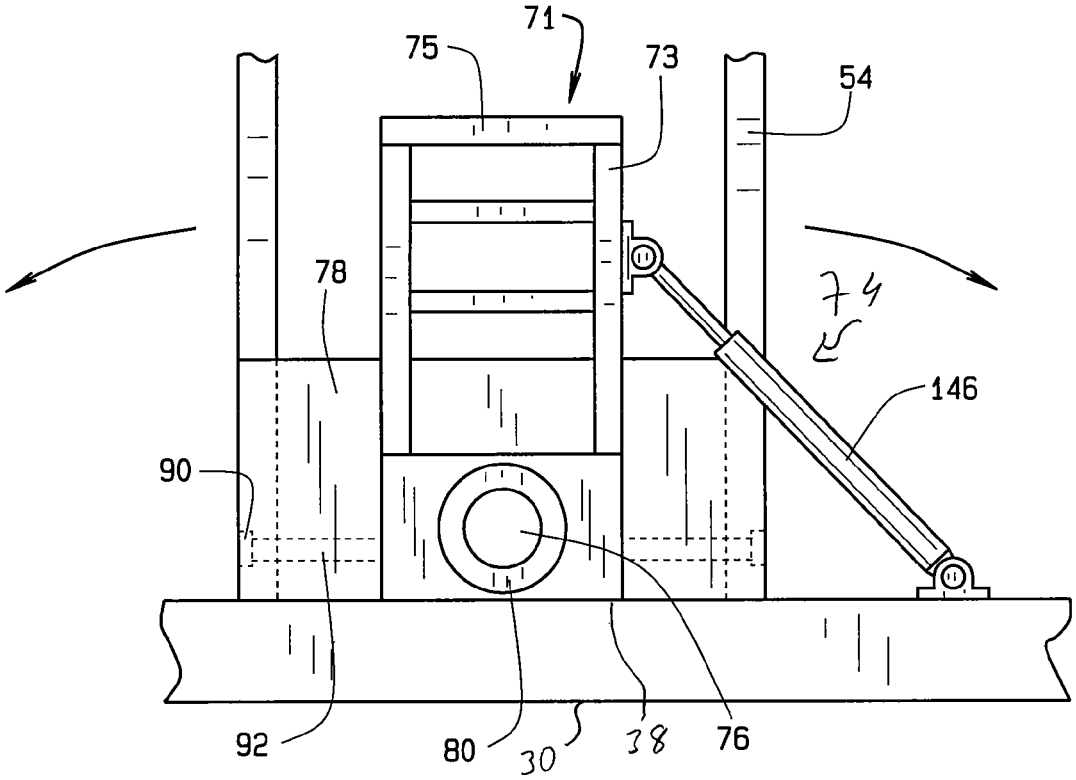
FIG. 11 is a partial rear view of a pivot assembly of the lift.

Turning to FIGS. 4-7 and referring to FIG. 11, the lift frame 36 rotatably connects to the chassis 14 via a pivot assembly 74. The pivot assembly 74 includes a pivot member 71. The pivot assembly further includes a rotatable shaft 76, a pivot plate 78 and pivot bearing 80 associated with the pivot member 71. The pivot member 71 has a vertical member 73 and a horizontal member 75 wherein the vertical member 73 connects with the shaft 76 via the pivot bearing 80. The vertical member 73 has a lower end positioned near the front end 38 of the support frame 30 and connects to shaft 76 around the pivot bearing 80. An upper end of the vertical member 73 terminates at position above the shaft 76 and adjacent the upright members 54 of the lift frame 36. The horizontal member 75 connects with the upper end of the vertical member 73 and extends outward from the upper end and toward the control interface 20 such that the horizontal member 75 suspends from the vertical member 73 (FIGS. 6 and 7).

The pivot plate 78 connects with the pivot member 71 near the lower ends of the vertical member 73. The rotatable shaft 76, which operatively connects with the fluid drive 18, extends from the engine platform 28 and connects with pivot member 71 of the pivot assembly 74 to rotatably connect the pivot plate 78 to the chassis 14. The shaft 76 is configured to rotate clockwise and counterclockwise about an axis of the lift arm 10 when acted upon by the fluid drive 18. The pivot bearing 80 supports the pivot member 71 and the rotatable shaft 76 such that the pivot plate 78 rotates with the shaft 76 and around the pivot bearing 80.

The pivot plate 78 includes a pair of rod bearings 90 (FIG. 11) positioned on opposite sides of the pivot plate 78. The rod bearings 90 rotatably support a rod 92 (FIG. 4) positioned therebetween. The rod 92 attaches to the upright members 54 of the lift frame 36 near the base member 56 such that the lift frame 36 rotates with the rod 92. The lift frame 36 is configured to rotate forward and backward around the rod bearings 90 when the fluid drive 18 acts upon the lift frame 36 as will be discussed. In particular, the lift frame 36 rotates with the rod to be tilted forwardly and backwardly with respect to the support frame 30 of the chassis 14. Further, since the lift frame 36 is rotatably connected to the pivot plate 78 via the rod 92, the lift frame 36 rotates in a pivoting manner with respect to the chassis 14 when the shaft 76 is acted upon by fluid drive 18 as will be discussed.

Figure 9:
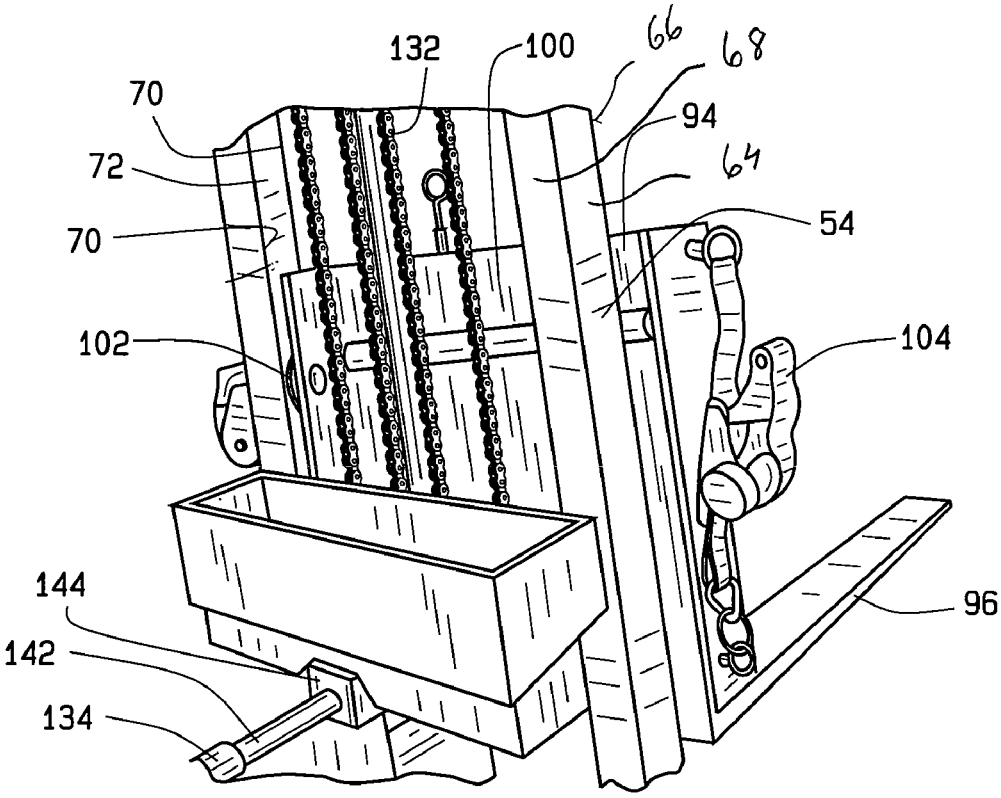
FIG. 9 is a partial rear view of the lift frame illustrating tracks of the lift frame and rolling members of the lift arm.
Figure 10:
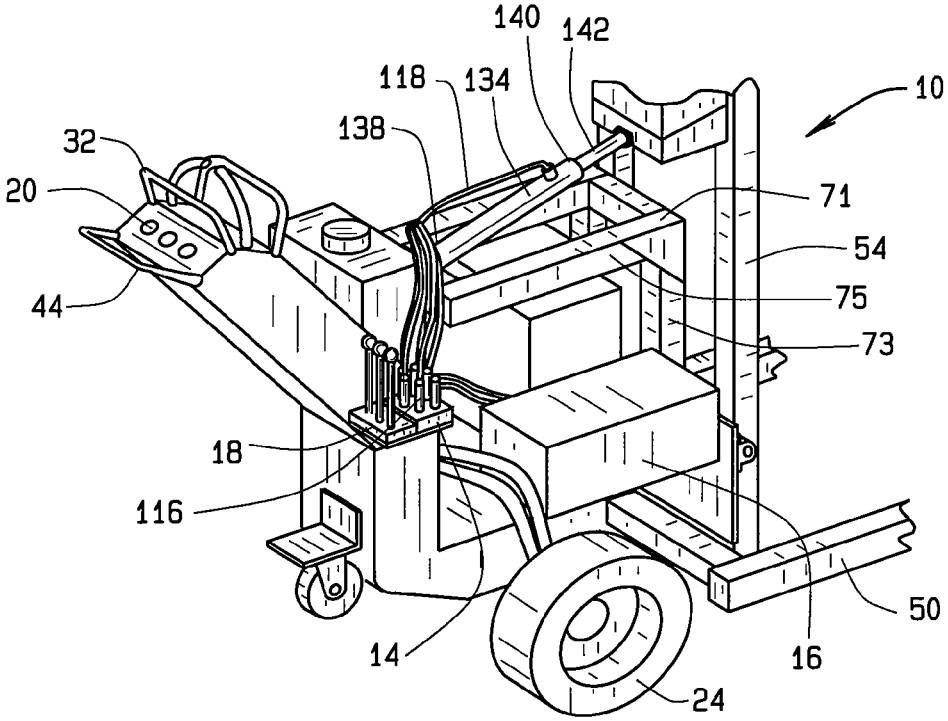
FIG. 10 is a rear perspective view of the lift of the present disclosure.

Turning to FIGS. 1 and 9, the lift arm 22 rotatably connects with the upright members 54 of the lift frame 36. The lift arm 22 comprises a lift plate 94 having forwardly extending forks 96 or tines. The lift plate 94 includes a front face 98 and a back face 100 wherein the forks 96 extend outward from the front face 98. Rolling members 102 extend from the back face 100 to be received within the grooves 70 of the upright members 54. The rolling members 102 are sized and shaped to fit within the grooves 70 and freely move with in the track 72 formed by the grooves 70. When acted upon by the fluid drive 18, the lift arm 22 can move upward and downward along the grooves 70 of the upright members 54 via the rolling members 102.

In an embodiment, the lift arm 22 can move a vertical distance along the tracks 72 up to and including ten feet. The lift arm 22 and tracks 72 can be constructed to have smaller or larger vertical distances. The distance dimension is for illustration purposes only. As shown in FIG. 13, come-alongs or tie-downs 104 removably attach to the lift plate 94 to assist in securing the unit 12 to the lift arm 22.

The power source 16 is an engine such as an internal combustion engine, mounted on the engine platform 28. In an embodiment, the engine 106 comprises a seventeen horsepower engine, although larger or smaller engines may be employed depending upon the desired size of the lift and/or load of the control unit 12. The power source 16 can also be an electrical motor. A drive mechanism such as a drive shaft or a drive chain operatively connects wheels 24 to the engine 106 to drive the lift 10. The wheels 24 of the lift 10 may include all-terrain tires 108 to help traverse different types of terrains. A back wheel 24 (FIGS. 6 and 7) positioned underneath the handle 32 can swivel to allow easy maneuverability of the lift 10 both when bearing a load and when not bearing a load. The back wheel 24 can assist in preventing overturning of the lift 10.

The fluid drive 18 comprises a pressurized fluid drive configured to move the lift frame 36 and the lift arm 22. The fluid drive 18 can be any pressurized fluid drive. However, for purposes of illustration only, the fluid drive 18 will be described as incorporating a hydraulic system. Other pressurized systems, such as a pneumatic system, may be employed. The fluid drive 18 includes a pump 112 driven by engine 106 and includes fluid tank 110 and a plurality of hydraulic cylinders 114. Alternatively, a separate motor can drive the pump 112. The tank 110 can have a volume of 1.1 gallons while the pump 112 can be a 1.4 gpm pump 112, although larger or smaller tanks 110 and/or pumps may be employed depending upon the desired size of the lift and/or load of the control unit 12.

The pump 112 directs hydraulic fluid from the tank 110 through associated fittings 116 and hoses 118 to the cylinders 114. In an embodiment, each cylinder 114 is a double acting cylinder. Cylinders 114 can be constructed in configurations other than a double acting cylinder. Valves are connected to the fluid drive 18 and control interface 20 for controlling the pressurized fluid flow to the cylinders 114. As designated below, the cylinders 114 include a lift cylinder 120, a tilt cylinder 134 and a pivot cylinder 146.

Returning to FIGS. 1-3 and 12, the lift cylinder 120 operatively connects to the lift frame 36 and to the lift arm 22 to control vertical displacement of the lift arm 22 along a vertical axis of the lift frame 36. The housing 122 of the lift cylinder 120 attaches to the lift frame 36 in a vertical orientation. As shown in the drawings, a lower end 124 of housing 122 attaches near the base member 56 of lift frame 36 while an upper end 126 of the housing 122 attaches to an intermediate cross support 58 between the upright members 54 of the lift frame 36. The piston 128 of the lift cylinder 120 exits the upper end 126 of the housing 122 to vertically reciprocate along the vertical axis when acted upon by the pressurized fluid. An end member of the piston 128 has a connector 130 such as a T-connector, wherein the connector 130 is configured to receive a length of a linkage member 132 such as a chain. The linkage member 132 connects to the T-connector 130 and connects to the lift plate 94 of the lift arm 22. When the lift cylinder 120 is activated to extend the piston 128 upward, the T-connector 130 and linkage member 132 rise with the piston 128. In response, the linkage member 132 then pulls up the lift plate 94 which travels via the rolling members 102 within the tracks 72 of the upright members 54. Conversely, when the lift cylinder 120 is activated to retract the piston 128, the lift arm 22 moves downward.

Turning to FIGS. 1, 6 and 7, the tilt cylinder 134 operatively connects to the pivot member 71 and to the lift frame 36 to control angular displacement of the lift frame 36 about an axis of the support frame 30. As shown, the cylinder 134 tilts the lift frame 36 forward (FIG. 6) and backward (FIG. 7) with respect to the support frame 30. The housing 136 of the tilt cylinder 134 attaches to the horizontal member 75 of the pivot member 71 in a substantially horizontal orientation. As shown in the drawings, the proximal end 138 of the housing 136 is orientated toward the control interface 20 and the distal end 140 of the housing 136 is orientated toward the lift frame 36. In an embodiment, the distal end 140 can be raised to angle upwardly with respect to the proximal end 138.

The piston 142 of the tilt cylinder 134 exits the distal end 140 and has a clevis connection that operatively connects with a bracket 144 of the lift frame 36. The piston 142 reciprocates relative to the housing 136 when the cylinder 134 is acted upon by a pressurized fluid. Pressurized fluid activates the tilt cylinder 134 to move the piston outward from the housing 136 which in turn tilts the lift frame 36 forward via the bracket 144 and away from the pivot member 71. Alternatively, pressurized fluid activates the lift cylinder 120 to move the piston 142 inward into the housing 136 to tilt the lift frame 36 backward and toward the pivot member 71. Thus, the tilt cylinder 134 is configured to pivot the lift frame 36 angularly about an axis with respect to the support frame 30. The tilt cylinder 134 can be constructed to pivot the lift frame 36 from about 45 degrees to about 135 degrees as measured between the front end 38 and the back end 40 of the support frame 30. The disclosed angular dimension is for illustration purposes only.

Referring to FIGS. 1, 4, 5, 11 and 12, the pivot cylinder 146 operatively connects to the wheel frame 34 and to the pivot member 71 of the pivot assembly 74 to control pivotal movement relative to the support frame 30 about another axis. As shown, the pivot cylinder 146 pivots the lift frame 36 clockwise (FIG. 4) and counterclockwise (FIG. 5), with respect to the support frame 30. A housing 148 of the pivot cylinder 146 attaches in an angled orientation to the wheel frame 34 and to the vertical member 73 of the pivot member 71. As shown in the drawings, a lower end 150 of the housing 148 attaches to the wheel frame 34 and the upper end 152 are orientated upward and toward the pivot member 71.

The piston 154 exits the upper end 152. The piston 154 has a clevis connection that operatively connects with the vertical member 73 of the pivot member 71. As noted, the pivot member 71 rotates with respect to the support frame 30 via shaft 76 and bearing 80 of the pivot assembly 74. The piston 154 exits the upper end 152 to reciprocate when acted upon by pressurized fluid. Pressurized fluid activates the pivot cylinder 146 to move the piston 154 outward from the housing 148 which in turn rotates the vertical member 73 of the pivot assembly 74 clockwise. Since the upright members 54 of the lift frame 36 connect with the pivot plate 78 via rod 92 and the pivot plate 78 connects to the vertical member 73 of the pivot member 71, the lift frame also rotates clockwise. Conversely, pressurized fluid activates the pivot cylinder 146 to move the piston 154 into the housing 148 to rotate the lift frame 36 counterclockwise via the pivot plate 78 and the pivot member 71. Thus, the pivot cylinder 146 is configured to reciprocally move the lift frame 36 angularly about an axis with respect to the support frame 30. The pivot cylinder 146 can be constructed to angularly rotate the lift frame 36 from about 45 degrees to about 135 degrees as measured between the side ends 42 of the support frame 30. The disclosed angular dimension is for illustration purposes only. Further, although one pivot cylinder 146 is shown, the lift 10 can include two pivot cylinders, one on each side of the pivot member 71.

A variety of sizes for hydraulic cylinders 114 may be employed as desired for a particular application or for a particular size of the control unit 12. Cylinders 114 can be 2.5×24 inch cylinders or 2×8 inch cylinders. The dimensions of the cylinders are representative of an embodiment and not intended to limit the scope of the disclosure. Any cylinder that can be employed to move and support the control unit 12 is intended to be within the scope of the disclosure.

Figure 12:
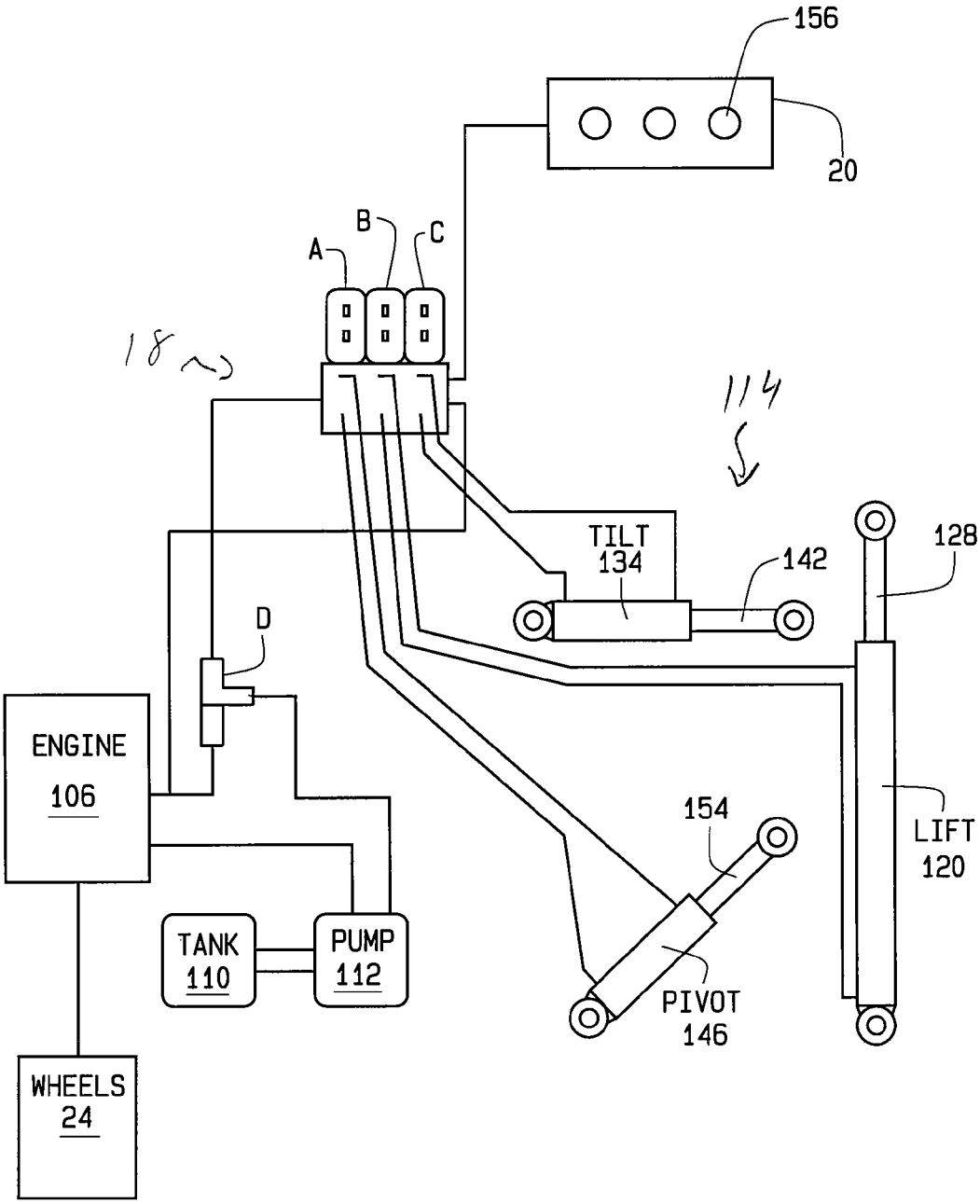
FIG. 12 is a schematic view of the fluid drive, control interface and power source of the present disclosure.

Valving and controls of various designs may be employed in the control lift 10 and its components. As shown in FIG. 12, valves A, B, and C are connected to the engine 106 and control interface 20. Valve A controls pivot cylinder 146; Valve B controls lift cylinder 120; and Valve C controls tilt cylinder 134. The valves can be proportional directional valves, rated 12V or can be closed directional valves, rated 12V. Valve D can be a normally open 12V flow control valve connected to pump 112 and tank 110 to regulate pressurized flow.

Control interface 20 may be mounted to the handle 32 to control some or all of valves A-D, and/or other components of lift 10. If desired, forward and reverse trigger switches 156 may be used to control the engine. These may be proportional 0-12V switches 156. Alternatively, the triggers 156 may be replaced with a single slide switch. Also, switches may be used to control the lift, tilt and pivot cylinders 114. Wiring may connect the controls to the valves or other controls components. Other types of switches and controls could be employed.

As seen in the drawings, hydraulic lift cylinder 120 controls the vertical displacement of the lift arm 22 and the hydraulic tilt cylinder 134 controls the forward and backward tilting of the lift arm 22. Still further, hydraulic pivot cylinder 146 controls the side-to-side pivoting of the lift arm 22. The control interface 20 controls the engine 106 for driving the wheels 24 of the lift 10 and controls the fluid drive 18. Through the use of the control interface 20, the lift 10 can be moved in a forward and backward direction and the lift arm 22 may be raised, lowered, and tilted forward and backward and pivoted from side to side.

During use and operation of the lift 10, the worker operates the control interface 20 to drive the lift 10 off a transport vehicle (not shown) such as a trailer or delivery truck. Alternatively, the lift 10 can be configured to directly mount to the end of a trailer (not shown) wherein the user can release the lift 10 from the trailer. Once the lift 10 is positioned on the ground, the user removes the fastener which holds the reciprocating members 48 within the fixed member 46. The worker then slides the reciprocating members 48 outward from the fixed member 46 which, in turn, widens the distance between the outrigger 50 and associated wheels 52. The user continues to slide the outriggers 50 outward until the desired width between the wheels 52 is achieved, since the wheel spacing assists in distributing the load or weight of the control unit 12. Upon achieving the desired width, the user re-fastens the reciprocating members 48 to the fixed member 46.

The user manipulates the control interface 20 to drive the lift 10 toward the control unit 12 which is typically positioned within a delivery truck (not shown) or a flat bed of a delivery truck. The user raises or lowers the lift arm 22 via controlling the lift cylinder 120 to bring the forks 96 into alignment with the bottom of the control unit 12. The operator then drives the lift forwardly to push the forks 96 underneath the control unit 12. The user regulates the cylinders 114 to raise or lower the lift arm 22 to properly load the control circuit onto the forks 96 of the lift arm 22. The user can fasten the control unit 12 by fastening the tie-downs 104 around the control unit 12 and attaching the tie-downs to the lift frame 36. The components of the lift 10 are configured to lift and carry the control unit 12 having a weight up to and including 1500 pounds. The user then activates the engine 106 to move the lift 10 and secured control unit 12 toward the installation site. A single worker may easily walk behind the lift 10 controlling the movement of the lift 10 by its control interface 20.

While traversing the ground terrain between the delivery vehicle and the installation site the lift 10 minimizes the adverse effects of the control unit's weight via the spaced wheel outriggers 50. Further, the all-terrain tires 108 assist in traversing the terrain G. If the terrain G becomes uneven, the user activates selected cylinders 114 via the control interface 20 to maintain the lift arm 22 and associated load level with the horizon. For example, if the terrain G slopes in a particular direction, the user can control the pivot cylinder 146 to move the pivot member 71 and connected lift frame 36 angularly in an opposite direction to maintain the control unit 12 level while the lift 10 traverses the sloped terrain. Additionally, while traversing landscaped terrain, the user can selectively control the cylinders 114 to raise or lower and/or tilt and/or pivot the lift frame 36 and lift arm 22 to navigate the control unit 12 around new plantings such as trees and shrubs. The lift 10 can include level sensors to automatically control the tilting and pivoting of the lift frame as the lift frame moves over the terrain.

At the installation site, the user selectively controls the hydraulic cylinders 114 in three degrees of movement (i.e., vertical, forward/backward tilt and side-to-side pivot) to accurately position the control unit 12 on the installation location. For example, for an elevated installation bracket located above uneven terrain or on landscaped terrain, the user activates the pivot cylinder 146 to pivot the lift frame 36 to compensate for the wheels 24 positioned on the uneven surface or to move around a landscaped surface. The user activates the lift cylinder 120 to raise or lower the control unit 12 above landscaped terrain to match the height of the elevated bracket.

The user then can activate the tilt cylinder 134 to assist in unloading the control unit 12 off of the forks 96 and onto the installation brackets. When the installation bracket is positioned within a confined space such as a space confined by electrical panels or landscaping, the user can control the hydraulic cylinders in three degrees of movement to raise or lower and/or tilt and/or pivot the lift frame 36 and lift arm 22 to position the control unit 12 on the installation bracket positioned within the confined space. Still further, when the installation bracket is positioned within a confined room such as a basement room or utility room, the user can control the hydraulic cylinders in three degrees of movement to raise or lower and/or tilt and/or pivot the lift frame 36 and lift arm 22 to position the control unit 12 while avoiding obstacles in the room.

In view of the above, it will be seen that advantageous results are obtained. As various changes could be made in the above constructions without departing from the scope of the disclosure, it is intended that all matter contained in the above description or shown in the accompanying drawings shall be interpreted as illustrative and not in a limiting sense.

The invention claimed is:

1. A lift for carrying a load, the lift comprising:

a chassis having a support frame, the support frame having a front end, a back end and opposing side ends;

a pivot member rotatably connected to the support frame, the pivot member having a pivot plate and a rod rotatably connected to the pivot plate;

a lift frame connected to the rod of the pivot plate, the lift frame having opposing upright members that extend upward from the rod and having a lift arm rotatably connected to the upright members, the lift arm comprising a tine extending outward therefrom; and a pressurized fluid drive operatively connected to the pivot plate, the lift frame and the lift arm, the pressurized fluid drive comprising a pivot cylinder mounted to the support frame and operatively connected to the pivot member, the pivot cylinder configured to pivot the lift frame and the tine from side-to-side between the opposing side ends, and wherein the fluid drive is configured to reciprocally move the pivot plate, the lift frame and the lift arm such that the lift arm moves in three degrees of movement with respect to the chassis.

2. The lift of claim 1 wherein the pressurized fluid drive comprises a lift cylinder vertically mounted to the lift frame and operatively connected to the lift arm.

3. The lift of claim 2 wherein the lift cylinder is configured to raise and lower the lift arm relative to the support frame.

4. The lift of claim 1 wherein the pivot cylinder angularly rotates the pivot member from between about 45 degrees to about 135 degrees as measured between the side ends of the support frame.

5. The lift of claim 1 wherein the pressurized fluid drive comprises a tilt cylinder operatively connected to the lift frame.

6. The lift of claim 5 wherein the tilt cylinder is configured to tilt the lift frame forward and backward about an axis to the support frame.

7. The lift of claim 6 wherein the tilt cylinder angularly rotates the lift frame from between about 45 degrees to about 135 degrees as measured between the front end and the back end of the support frame.

8. The lift of claim 1 wherein each upright member includes a groove and the lift arm includes a rolling member wherein the groove is configured to slidably receive and maintain the rolling member.

9. The lift of claim 1 wherein the support frame includes a pair of outriggers having wheels, the wheeled outriggers being telescopically adjustable to selectively adjust the distance between the outriggers.

10. The lift of claim 1 further comprising a control interface operatively connected to the pressurized fluid drive and configured to selectively manipulate the fluid drive to selectively position the lift arm in the three degrees of motion relative to the chassis.

11. A walk behind lift for carrying a load, the lift comprising:

a chassis having a support frame and a power source, the support frame having a front end, a back end, opposing side ends and a handle;

a pivot member rotatably connected to the support frame, the pivot member having a pivot plate and a rod rotatably connected to the pivot plate;

a lift frame connected to the rod of the pivot plate, the lift frame having opposing upright members that extend upward from the rod and having a lift arm rotatably connected to the upright members; and a pressurized fluid drive operatively connected to the power source, the pressurized fluid drive comprising a lift cylinder vertically mounted to the lift frame and operatively connected to the lift arm to reciprocally move the lift arm vertically, a pivot cylinder angularly mounted to the support frame and operatively connected to the pivot member to pivot the lift frame side-to-side from between about 45 degrees to about 135 degrees as measured between the side ends of the support frame, and a tilt cylinder mounted to the support frame and operatively connected to the lift frame to tilt the lift frame forward and backward about another axis; and a control interface operatively connected to the power source and to the pressurized fluid drive, the control interface being configured to selectively manipulate at least one of the lift cylinder, the tilt cylinder and pivot cylinder to selectively position the lift arm through three degrees of movement relative to the chassis.

12. The lift of claim 11 wherein the tilt cylinder is configured to reciprocally move the lift frame with respect to the support frame from between about 45 degrees to about 135 degrees as measured between the front end and the back end of the support frame.

13. The lift of claim 11 wherein the lift arm is configured to hold the control unit having a weight up to and including 1500 lbs.

14. The lift of claim 11 wherein the support frame includes a pair of outriggers having wheels, the wheeled outriggers being telescopically adjustable to selectively adjust the distance between the outriggers.

15. The lift of claim 14 wherein the pair of wheeled outriggers are adjustably spaced from each other between a range from about 30 inches to about 50 inches.

16. A method of moving an environmental control unit across a terrain and toward an installation site and setting the control unit on the installation site, the method comprising:

providing a chassis having a lift frame and having a lift arm adjustably connected to the lift frame;

providing a pressurized fluid drive operatively connected to the lift frame and the lift arm; moving the chassis toward the control unit;

adjusting wheels of the chassis to set a width distance between the wheels based on a weight of the control unit;

loading the control unit onto the lift arm;

grasping a handle of the chassis;

moving the chassis across the terrain and toward the installation site;

selectively activating the pressurized fluid drive to move at least the lift frame and lift arm to maintain the loaded control unit substantially level with respect to the terrain; and selectively activating the pressurized fluid drive to move at least the lift frame and lift arm through three degrees of movement by at least one of vertically lifting the lift arm, by pivotally moving the lift frame from between about 45 degrees to about 135 degrees as measured between the side ends of the chassis and by tilting the lift frame from between about 45 degrees to about 135 degrees as measured between front end and back ends of the chassis to set the control unit on the installation site.

* * * * *